US009752339B2

(12) United States Patent
Newman

(10) Patent No.: US 9,752,339 B2
(45) Date of Patent: Sep. 5, 2017

(54) ENVIRONMENTALLY FRIENDLY METHOD FOR DESIGNING AND UTILIZING MIXED USE DEVELOPMENTS

(71) Applicant: Kevin Newman, Corona del Mar, CA (US)

(72) Inventor: Kevin Newman, Corona del Mar, CA (US)

( * ) Notice: Subject to any disclaimer, the term of this patent is extended or adjusted under 35 U.S.C. 154(b) by 912 days.

(21) Appl. No.: 13/785,410

(22) Filed: Mar. 5, 2013

(65) Prior Publication Data

US 2013/0199115 A1 Aug. 8, 2013

Related U.S. Application Data

(63) Continuation of application No. 12/784,656, filed on May 21, 2010, now abandoned.

(60) Provisional application No. 61/182,620, filed on May 29, 2009.

(51) Int. Cl.

| | |
|---|---|
| ***E04H 6/08*** | (2006.01) |
| ***E04H 1/04*** | (2006.01) |
| ***G06Q 99/00*** | (2006.01) |

(52) U.S. Cl.

CPC ..... *E04H 6/08* (2013.01); *E04H 1/04* (2013.01); *G06Q 99/00* (2013.01)

(58) Field of Classification Search

USPC ..... 705/315

See application file for complete search history.

(56) References Cited

PUBLICATIONS

"Site Plan: Sketches, Preliminary Site Study" (available online as accessed on Sep. 11, 2006 by Web Archive at http://web.archive.org/web/20060911075436/http://scholar.lib.vt.edu/theses/available/etd-05212003-101621/unrestricted/siteplans.pdf).*

(Continued)

*Primary Examiner* — Jan P Mincarelli

(74) *Attorney, Agent, or Firm* — Haynes and Boone LLP

(57) ABSTRACT

A mixed-use development that includes one or more buildings in an approximate L-shape along a parcel of land wherein one elongate axis of the one or more buildings in an approximate L-shape is positioned substantially parallel to a first edge of the parcel of land. The first edge of the parcel of land may be positioned near a road or sidewalk. A separate building that has an axis that is substantially parallel to one of the axis of the one or more buildings in an approximate L-shape may be positioned near the one or more buildings in an approximate L-shape to form an approximate U-shape of buildings with a green space in the interior of the U-shape of buildings. The green space may be elevated above ground level. A method of designing a mixed-use development is also provided.

8 Claims, 2 Drawing Sheets

(56) References Cited

PUBLICATIONS

Columbia Plaza "Site Plan" (available online at http://www.columbiaplaza.net/site-plan/).*
Pamela Scott and Antoinette J. Lee, Buildings of the District of Columbia, Oxford University Press 1993 pp. 204-218.*
Google Maps Street Views, 3 pages, of Columbia Plaza as seen driving through the driveway from E Street NW toward Virginia Avenue NW, captured Aug. 2007.*
Kevin Newman, New Block Urban Infill No Concrete Structures, Power Point Presentation, May 2009, Newport Beach, CA/U.S.A. (24 pages).
Office Action mailed May 9, 2012, by the USPTO, in connection with U.S. Appl. No. 12/784,656.
Final Office Action mailed Dec. 10, 2012, by the USPTO, in connection with U.S. Appl. No. 12/784,656.
Map, Microsoft Live Search, 2007 (1 page).
Bridgette Meinhold, "Manhattan Apartment Meets Garden Escape," Oct. 3, 2008 (6 pages).

* cited by examiner

ENVIRONMENTALLY FRIENDLY METHOD FOR DESIGNING AND UTILIZING MIXED USE DEVELOPMENTS

CROSS-REFERENCE TO RELATED APPLICATIONS

This application is a continuation of U.S. application Ser. No. 12/784,656, filed on May 21, 2010, which claims the benefit of the filing date of U.S. application Ser. No. 61/182,620, filed on May 29, 2009, the entire disclosures of which are incorporate herein by reference.

BACKGROUND OF THE INVENTION

Traditional shifts in the economy, both positive and negative, generally have a broad impact on various areas of technology, business, and development. Larger shifts in the economy, such as those that are classified as a recession, generally have a wide sweeping and nearly all inclusive impact on every sector of the economy. For example, the recent (2008-2009) economic downturn in the United States, which was subsequently felt in nearly every economically developed nation, has impacted essentially every business sector of the US economy, and further, the impact has been significant enough that several business sectors have been forced to essentially reinvent themselves.

One example of a business sector that has been significantly impacted by the economic downturn is the urban commercial development industry, which includes architects, designers, builders, realtors, etc. More particularly, the current economic downturn appears to have substantially reprioritized urban real estate/housing consumer expectations and desires. For example, urban real estate/housing consumers now appear to be seeking more environmentally friendly housing, whereas in the past environmental concerns rarely factored into an urban real estate purchase decision. The urban environmentally friendly expectations and desires may include that ample "green space" be provided by a particular urban housing unit, the proximity of the urban housing unit to public (green) transportation, and the housing unit's energy efficiency ratings.

Therefore, in the view of the evolving consumer expectations and desires in the urban commercial development industry, there is a need for a method or system for designing a mixed-use urban housing development that is substantially based on green technology.

SUMMARY OF THE INVENTION

Embodiments of the present disclosure may generally provide a method or system for designing a mixed-use urban housing development, wherein the development includes increased building efficiency, high yield average net rentable square footage, solid return on investment, and increased open space (generally above 25% of the open space). The system or method may be configured to provide the above noted features or advantages in a relatively confined space, such as, for example, a two acre site, where the site includes multiple story residential units, retail, parking, while still maintaining 25+% near ground level open or green space for the tenants to enjoy.

Embodiments of the present disclosure may further provide a method for designing a mixed-use development by positioning buildings and a green space on a parcel.

Embodiments of the present disclosure may further provide a method for designing a mixed-use development by using computer aided design software.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
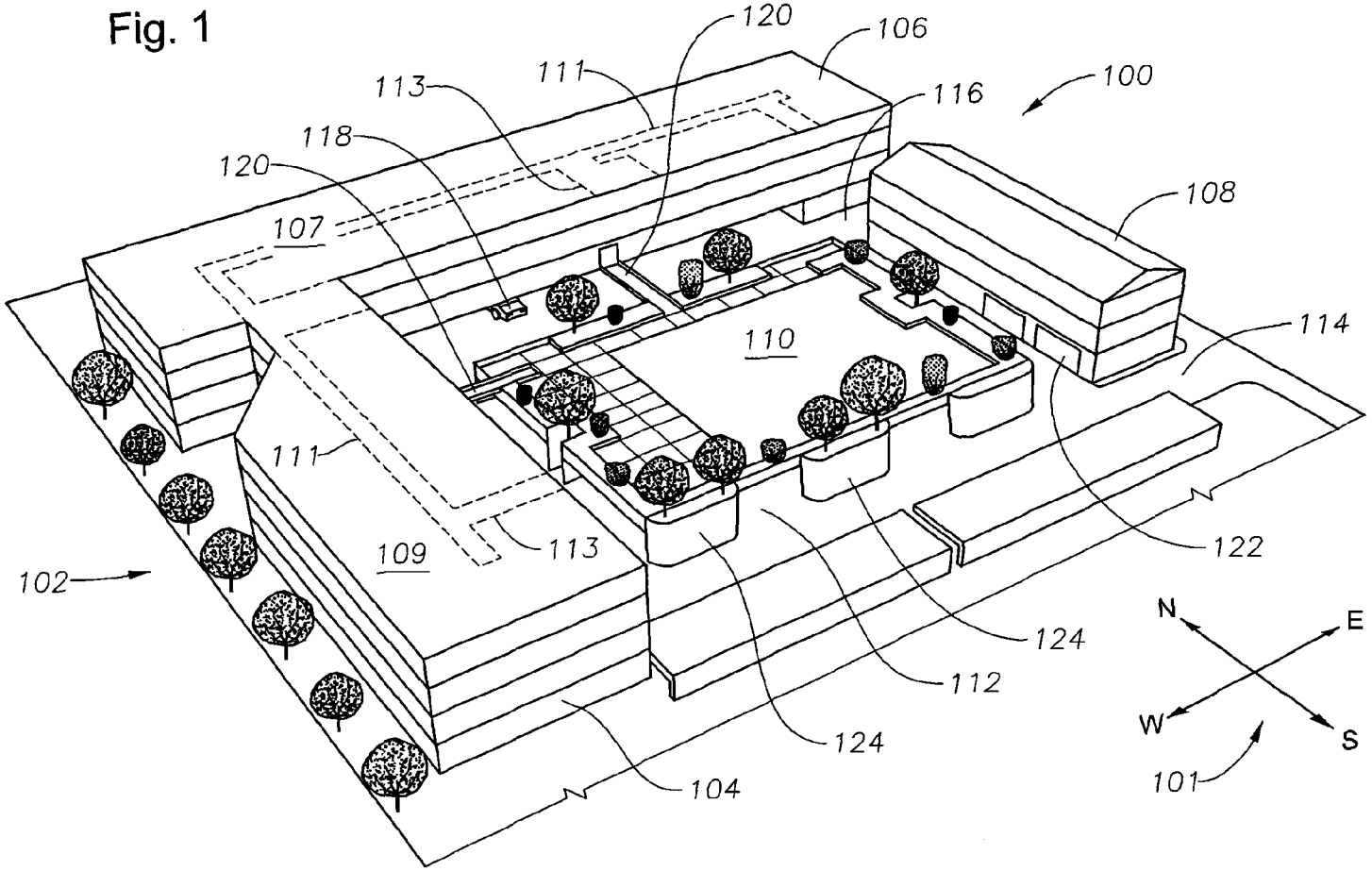
FIG. 1 illustrates a perspective view of exemplary mixed-use development project of the present disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from an exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope.

FIG. 1 illustrates a perspective view of exemplary mixed-use development project of the present disclosure. The development project 100 is generally positioned on a parcel of land 102, which may be a small city block-sized parcel.

In one exemplary embodiment of the present disclosure, the parcel 102 may be square or rectangular in shape and may encompass approximately a two acre site that may be surrounded on at least two sides by publicly accessible roads. The perimeter of the parcel 102 may include sidewalks or other walkways that allow pedestrians to pass by the parcel 102 on at least two sides thereof.

Figure 2:
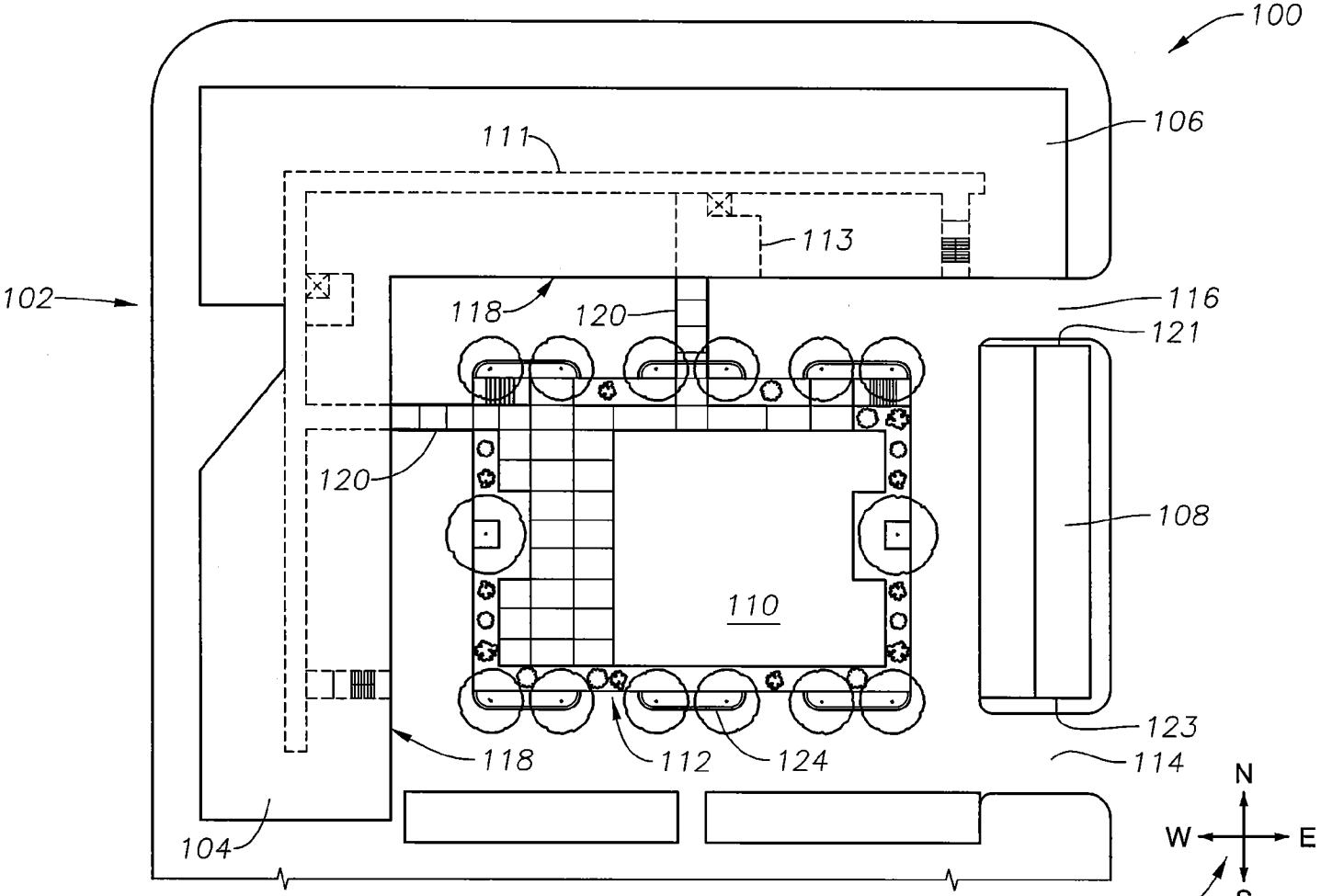
FIG. 2 illustrates a plan view of an exemplary mixed-use development project of the present disclosure.

Without limiting the scope of the invention, Applicants note that a directional legend 101 has been added to each of FIGS. 1 and 2. This directional legend 101 is purely exemplary and for discussion purposes only, and does not in any way limit the scope of the invention by dictating a particular orientation of the elements of the project 100.

Returning to the discussion of FIG. 1, the development project 100 generally includes two primary building structures 106 and 108. The first building structure 106 may be a multi-level residential building that also contains a portion thereof that is dedicated to retail space. More particularly, the building structure 106 may include a two to four story residential building containing residential units on each of the individual floors above the ground level. A portion of the ground level of building structure 106 may include retail space, and the remainder of the ground level of building structure 106 may include tuck under parking spaces 118 for the residential units positioned on the upper floors thereof. Generally speaking, although not limited to this configuration, the retail space positioned on the ground level of building structure 106 may be on the outer side of the building structure 106, i.e., on the sides of the building structure 106 that the face the sidewalk or road. The tuck under parking 118 will generally be positioned on the interior side of building 106 facing the green area 110.

In order to efficiently utilize the space provided by the parcel 102, the building structure 106 may generally be configured as an L-shaped building structure. For example, building structure 106 may include a first substantially linear building portion 107 that may extend along the north side of the parcel 102 in a generally east-west direction. Further, the building structure 106 may include a second substantially linear building portion 109 that may extend along the west side of parcel 102 in a generally north-south direction. The terminating ends of the respective building portions (107, 109) may be connected at the northwest corner of the parcel 102, thus creating the L-shaped building structure 106. The connection of the respective buildings may generally be made at a right angle, or substantially close thereto, thus generating the L-shaped building 106. The L-shaped building structure will generally be positioned on the parcel 102 such that the first or upstanding portion of the L-shape 107 is positioned substantially parallel to a road or a sidewalk that passes by the edge of the parcel 102 and generally positioned relatively close to the road as well (with an interstitial sidewalk). Further, the second or bottom portion 109 of the L-shaped building structure 106 may also be positioned parallel to a passing road or sidewalk, as the second portion 109 is generally connected to the first portion 107 at a substantially right angle, thus allowing the L-shaped building 106 to mirror two edges of a square or rectangular city block.

The L-shaped building 106 may generally be between two and four stories tall, although embodiments of the invention are not intended to be limited to any particular height of the respective buildings. The L-shaped building 106 may be configured with a central corridor 111 having residential units positioned on each side thereof. Thus, residential units on one side of the corridor 111 will face outward (north or west) from the center of the parcel 102, while the residential units on the other side of the corridor 111 will face inward (south or east) toward the center of the parcel 102. The central corridor 111 may also include a plurality of side corridors 113 that may exit the building 106 on various sides thereof. At least one of the corridors 113 may be positioned on a second or third floor of the building 106 and may exit the building 106 to an elevated walkway 120 that may connect to the building 106 to a centrally positioned green space 110. Further, additional walkways (not shown) may be provided through the respective buildings to allow pedestrian traffic from the interior portion of parcel 102 to the exterior of the respective buildings. The upper floors (the second floor through the top floor) may include a plurality of residential units that may generally include approximately 70% one-bedroom units and approximately 30% two-bedroom units having a square footage of between about 650 $ft.^2$ to about 1000 $ft.^2$.

The development project 100 further includes a second building 108 positioned on an east side of the parcel 102 and extending in a generally north south direction. The second building 108 may generally be rectangular in shape and may have an elongated axis that is parallel to an elongated axis of the second portion 109 of the L-shaped building 106. Thus, the combination of the L-shaped building 106 and the second building 108 may create a U-shaped building configuration with a central area that is interior (surrounded by) the respective buildings 106, 108.

FIG. 2 illustrates a plan view of an exemplary mixed-use development project of the present disclosure and shows an exemplary position and orientation of the second building 108. The second building may generally be a multi-story (2-5 stories) residential building having residences on each of the respective floors. An alternative embodiment, the outer portion of building 108, i.e., the east side that faces the road or sidewalk, may include some retail space therein.

The terminating ends of the rectangularly shaped building 108 may be positioned such that a first terminating in 121 is positioned proximate a terminating end of the L-shaped building 106. The second terminating in 123 of the second building 108 may be positioned proximate the southeast corner of the parcel 102 at a southward distance that is close to the southward distance of the terminating end 104 of the L-shaped building 106.

The space between terminating end 121 of the second building 108 and the L-shaped building 106 may generally form a driveway 116 that is configured to allow vehicle traffic to enter into the interior portion of the parcel 102, i.e., into the portion was surrounded by the respective buildings. The driveway 116 may extend through a substantial portion of the interior of the parcel 102 and allow vehicle traffic to leave the interior portion of the parcel 102 via an exit driveway 114. Applicants note that the direction of vehicle traffic, i.e. the entrance and exit notations, are not intended to be limiting upon the scope of the invention, as vehicle traffic may travel in and out of the respective entrances/exits in either direction. The interior side of second building 108, i.e., the side of building 108 facing the center of parcel 102, may include a plurality of vehicle garages 122. Alternatively, tucked under parking spaces 118 may be provided.

Generally speaking, vehicles may enter and exit the interior portion of parcel 102 via the driveways 114, 116. The central portion of parcel 102, at least the ground-level portion thereof, may generally be paved to allow for vehicle traffic. Thus, vehicle traffic may circulate in the anterior portion of the parcel 102 to have access to the tucked under parking spaces 118, the garage space is 122, and the other parking spaces provided under the green space 110, which will be further discussed herein.

The central portion of the parcel includes a novel green space 110. The green space 110 generally includes a one-story structure configured to elevate an environmental surface above the traditional ground level. More particularly, the green space 110 is configured to elevate a park-like surface including grass, trees, and other landscaping above a single-story parking facility. Thus, vehicles may enter into the interior portion of the parcel 102 and drive under the green space 110 into the parking portion 112. The green space 110 may be vertically supported by a plurality of support members 124 positioned at various locations around the perimeter (and potentially on the interior) of the green space 110. One novel feature of the present invention is that the green space 110 may be supported by a structure that is substantially manufactured from wood products. For example, the support members 124 may be manufactured from wood or timber, and decking or horizontal support material that interconnects the respective support members 124 and supports the park-like green space may also be manufactured from a wood material. Thus, the green space 110 may be environmentally friendly from a manufacturing standpoint.

The green space 110 may include a plurality of openings 112 on the sides thereof, i.e. between the respective support members 124. These openings 112 may be used for ingress and egress of vehicles from the parking facility provided under the green space 110. The upper surface of the green space 110 may generally be covered with park-like landscaping. For example, the upper surface of green space 110 may include grassy areas, trees, bushes, picnic areas, and other environmentally friendly areas that may be used by the residents of the development project 100. Further, the area of the green space 110 may be between about 20% and about 30% of the total surface area of the parcel 102. Thus, the present disclosure utilizes green materials (wood framing as opposed to concrete) to create a development project 100 having a substantial surface area (green space 110) devoted to green living.

In another embodiment, the building structure 106 may be two separate buildings arranged in a general L formation. In another example, the development project 100 may include only a L shaped building, without the second building structure 108, wherein the L shaped building is either formed by two separate buildings arranged in a L formation or a single building constructed in a L shape. Alternatively, the development project 100 may include multiple buildings that line the perimeter of the parcel 102. The number of buildings does not in any way limit the scope of the invention by dictating a particular orientation of the elements of the project 100.

Embodiments of the present disclosure may also provide a method for designing the development project described above. For example, the method may include providing or positioning any of the elements listed or described above on a particular parcel. Furthermore, in embodiments of the invention where the design process may be conducted using a computer aided drafting software package, embodiments of the invention may include the software or supporting hardware used to design a development project. More particularly, at least one embodiment of the invention may be implemented as a program product for use with a computer system or processor. The program product may define functions or operational steps (of the design of the development project) of the exemplary embodiments (which may include design methods or processes for the elements) described herein and can be contained on a variety of computer readable media. Illustrative computer readable media include, without limitation, (i) information permanently stored on non-writable storage media (e.g., read-only memory devices within a computer such as CD-ROM disks readable by a CD-ROM drive); (ii) alterable information stored on writable storage media (e.g., computer disks for use with a disk drive or hard-disk drive, writable CD-ROM disks and DVD disks, zip disks, portable memory devices, and any other device configured to store digital data); and (iii) information conveyed across communications media, (e.g., a computer, telephone, wired network, or wireless network). These embodiments may include information shared over the Internet or other computer networks. Such computer readable media, when carrying computer-readable instructions that perform methods of the invention, may represent embodiments of the present invention.

Further still, in general, software routines or modules that implement embodiments of the invention may be part of an operating system or part of a specific application, component, program, module, object, or sequence of instructions, such as an executable script. Such software routines typically include a plurality of instructions capable of being performed using a computer system or other type or processor configured to execute instructions from a computer readable medium. Also, programs typically include or interface with variables, data structures, etc. that reside in a memory or on storage devices as part of their operation. In addition, various programs described herein may be identified based upon the application for which they are implemented. Those skilled in the art will readily recognize, however, that any particular nomenclature or specific application that follows facilitates a description of the invention and does not limit the invention for use solely with a specific application or nomenclature. Furthermore, the functionality of programs described herein may use a combination of discrete modules or components interacting with one another. Those skilled in the art will recognize, however, that different embodiments may combine or merge such components and modules in a variety of ways.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A site located on a parcel of land, the site comprising:

a first building, comprising:

first and second substantially linear portions, wherein respective terminating ends of the first and second substantially linear portions are connected to each other, wherein the second substantially linear portion is perpendicular to the first substantially linear portion, and wherein at least one of the first and second substantially linear portions comprises a plurality of residential units for residents of the first building;

an elevated structure, wherein the elevated structure defines a first side and a second side perpendicular thereto, wherein the first and second sides of the elevated structure are parallel to the first and second substantially linear portions, respectively, of the first building, wherein the elevated structure defines a top surface, the top surface including a green space area for use by at least the residents of the first building, wherein the green space area comprises:

a grassy area, and a non-grassy area, the non-grassy area being coplanar with the grassy area, and wherein the elevated structure is positioned at a height above ground level and defines a space extending between ground level and the elevated structure;

a plurality of vertical support members that extend upward from ground level and support the elevated structure, wherein the plurality of vertical support members are comprised of wood material;

a plurality of horizontal support members that extend horizontally between the plurality of vertical support members and support the elevated structure, wherein the plurality of horizontal support members interconnect the plurality of vertical support members, and wherein the plurality of horizontal support members are comprised of wood material;

an above-ground parking facility positioned underneath the elevated structure within the space extending between ground level and the elevated structure, wherein the above-ground parking facility is at least partially defined by the elevated structure and the plurality of vertical support members;

an opening defined vertically between ground level and the elevated structure, and horizontally between two of the vertical support members and adapted to provide vehicle ingress to, and/or vehicle egress from, the above-ground parking facility;

a ground level driveway providing ground level access to the opening and thus to the above-ground parking facility;

a first elongated region defined between the first substantially linear portion of the first building and the first side of the elevated structure, wherein the first elongated region is sized to permit vehicle traffic along the first substantially linear portion of the first building and between opposing ends of the first side of the elevated structure; and a second elongated region defined between the second substantially linear portion of the first building and the second side of the elevated structure, wherein the second elongated region is sized to permit vehicle traffic along the second substantially linear portion of the first building and between opposing ends of the second side of the elevated structure, wherein the second elongated region is perpendicular to the first elongated region, wherein respective terminating ends of the first and second elongated regions are joined to permit vehicle traffic between the first and second elongated regions, and wherein the respective terminating ends of the first and second elongated regions are joined at a location adjacent to where the respective terminating ends of the first and second substantially linear portions of the first building are connected;

wherein the site, including at least the first building, the elevated structure, the ground level driveway, and the first and second elongated regions, defines a first surface area;

wherein the green space area of the elevated structure defines a second surface area;

wherein the second surface area of the green space area of the elevated structure ranges from 20% to 30% of the first surface area defined by the site; and wherein the site is adapted for use in a high-density, urban infill project with a limited amount of available square footage, the green space area defined by the elevated structure provides a green living experience to users of the site while maintaining a limited footprint, and the wood material from which the pluralities of vertical and horizontal support members are comprised enables the site to be environmentally friendly.

2. The site of claim 1, wherein the elevated structure defines a third side parallel to the first side and perpendicular to the second side; and wherein the building structure further comprises a second building that extends substantially linearly and is parallel to the third side of the elevated structure.

3. The site of claim 2, further comprising:

a third elongated region defined between the second building and the third side of the elevated structure, wherein the third elongated region is sized to permit vehicle traffic along the second building and between opposing ends of the third side of the elevated structure.

4. The site of claim 1, further comprising:

a first elevated walkway extending:

between the first substantially linear portion and the top surface of the elevated structure, and above the first elongated region.

5. The site of claim 4, further comprising:

a second elevated walkway extending:

between the second substantially linear portion and the top surface of the elevated structure, and above the second elongated region.

6. The site of claim 4, wherein the first building comprises a corridor that exits the first building at the first elevated walkway.

7. The site of claim 1, wherein the second substantially linear portion of the first building defines a horizontally-extending surface under which tucked under parking spaces are positioned.

8. The site of claim 1, wherein the green space area defines a first height and at least a portion of the residential units are positioned at a second height that is greater than the first height.

* * * * *